US005618030A

United States Patent [19]

Eggert

[11] Patent Number: 5,618,030

[45] Date of Patent: Apr. 8, 1997

[54] SNOWMOBILE JACK

[76] Inventor: Richard L. Eggert, 3625 409th Ave. NW., Braham, Minn. 55006

[21] Appl. No.: 620,792

[22] Filed: Mar. 28, 1996

[51] Int. Cl.[6] ..... B66F 3/00

[52] U.S. Cl. ..... 254/131

[58] Field of Search ..... 254/131, 132, 254/8 B, 44, 113, 120

[56] References Cited

U.S. PATENT DOCUMENTS

| | | | |
|---|---|---|---|
| 186,402 | 1/1877 | Lottridge | 254/131 |
| 260,276 | 6/1882 | Bovey | 254/131 |
| 293,703 | 2/1884 | Bazill | 254/131 |
| 356,443 | 1/1887 | Black | 254/131 |
| 1,387,992 | 8/1921 | Lake | 254/131 |
| 3,667,728 | 6/1972 | Garelick | 254/131 |
| 3,907,254 | 9/1975 | Richards | 254/131 |
| 3,964,729 | 6/1976 | Harlow | 254/131 |
| 3,990,593 | 11/1976 | Guger . | |
| 4,643,396 | 2/1987 | Beals . | |
| 5,000,423 | 3/1991 | Snickers | 254/131 |
| 5,143,352 | 9/1992 | Latimer . | |
| 5,145,154 | 9/1992 | Bastille et al. . | |
| 5,209,505 | 5/1993 | Bastille et al. . | |
| 5,211,265 | 5/1993 | Gregg . | |
| 5,232,203 | 8/1993 | Butts | 254/131 |
| 5,380,141 | 1/1995 | Flowers . | |
| 5,441,378 | 8/1995 | Puls . | |
| 5,518,224 | 5/1996 | Anderson | 254/131 |

*Primary Examiner*—Robert C. Watson
*Attorney, Agent, or Firm*—Janet Peyton Schafer

[57] ABSTRACT

A jack for raising an object to an inclined position. A jack particularly adapted for inclining a snowmobile enabling exposure of the underside thereof for maintenance of the snowmobile, and for preventing freezing of the snowmobile track onto a surface during storage of the snowmobile. The jack has a frame, of triangular shape, which is itself supported, at a first end, by a rectangular shaped base. A handle pivots about a second end of the frame, the handle having a hook at a first end, for temporarily engaging the snowmobile, and a grip at a second end. The jack enabling the user to manually push the handle downwardly inclining the snowmobile engaged by the first end of the handle. A cable, having engagement means mounted to the grip end of the handle, provides attachment of the cable to a crosspiece, the crosspiece interconnecting two sides of the triangular shaped frame, for maintaining the snowmobile in an inclined position. The jack, because the frame hinges about the base and the handle pivots about the frame, may by folded in a relatively flat, planar position for storage.

15 Claims, 2 Drawing Sheets

SNOWMOBILE JACK

BACKGROUND

This invention relates generally to a portable device for lifting and supporting a heavy object in an inclined or tilted position. This invention specifically relates to a jack for use with snowmobiles or other objects.

In the interest of maintaining a long useful life of a snowmobile, it is important to get the entire snowmobile track off the ground for storage to remove the weight of the snowmobile from the track suspension. This protects and maintains the correct tautness of the track suspension. Additionally, keeping the track off the ground aids in keeping the track from deteriorating as a result of environmental conditions. Also, being able to lift the snowmobile track from the ground keeps the track from freezing to the ground. This enables immediate usage of the snowmobile without a preliminary warmup period that might damage the track suspension if the track is at least momentarily immovable as a result of being frozen into surrounding ice. Additionally, lifting the track up from the ground enables the user to run the track to free the track of any ice or snow prior to storage. It is important to get all of the track off the ground, leaving the snowmobile skis only in contact with the ground.

Generally, the available snowmobile lifting devices fall into two main groups. The first group consists of generally bulky, heavy devices that cannot be conveniently stored or transported for use. An example of this group is a snowmobile jack having a three-dimensional tripod frame, requiring use of multiple elements, including linkage to connect a second end of a lever to lift a rod along a rod guide channel. The lever is used to lift vertically the lift rod that lifts a snowmobile attached to the rod by a hook. Another example of this group is a snowmobile jack requiring hydraulic means for lifting the snowmobile. One of these previous jacks provides a scissor-like frame that folds down to permit the snowmobile to be driven thereon, the hydraulic means lifting the frame and snowmobile to the desired level.

The second main group of available snowmobile jacks provides a stand, usually T-shaped, to prop up at least one end of the snowmobile after the user has manually lifted the heavy device. An obvious problem is the necessity of the user manually lifting one of these heavy machines.

None of these previous jacks provide a simple, easy to use, light weight, portable jack for lifting heavy objects, including a snowmobile, that can be folded flat for storage.

SUMMARY

The present invention is directed to a portable device for lifting heavy objects that satisfies these needs for a simple, easy to use, device for lifting heavy objects manually yet is portable and conveniently stored.

A jack having features of the present invention comprises a triangular shaped frame, pivotably attached to a supporting base. The frame has two upright legs of equal length and a lower leg, the lower leg is hinged to the supporting base. A handle pivots about a bolt attached to the frame at the intersection of the two upright legs. The handle has a hook end and a grip end. A crosspiece interconnects the two upright legs. A cable, having an engagement means attached at a first end, is attached at a second end to the grip end of the handle so that to raise the object to an inclined position the jack is positioned with the base beneath the object and the hook is attached to the object, the grip end of the handle is lowered toward the base, thereby raising the hook and inclining the attached object and the engaging means is engaged to the crosspiece, thereby securing the object in the inclined position relative to the base. The object to be inclined is a snowmobile, raised at the rear of the snowmobile. The frame hinges about the base, enabling the jack to be stored in a relatively flat position. The base is planar with a nonskid bottom surface. The frame and handle are of tubular steel. The upright legs are of equal length and the handle is longer than any of the legs.

A jack having features of the present invention comprises a triangular shaped frame, pivotably attached to a base and a handle pivotably attached to the frame. The frame has two upright legs of equal length and a lower leg, the lower leg is hinged to the base. The base is a rectangular shaped grid having a rubber or plastic applied to provide a non-skid bottom surface. A handle pivots about a bolt attached to the frame at the intersection of the two upright legs. The handle has a hook end and a grip end. A crosspiece interconnects the two upright legs of the triangular shaped frame at a predetermined point on each upright leg. The crosspiece is generally parallel to the lower leg of the base. A cable, having an engagement means attached at a first end, is attached at a second end to the grip end of the handle. This engagement means attaches the cable to the crosspiece holding the jacked up object upright when the jack is in its position of use. The handle pivots manually about the frame to engage the object to be lifted, raising the object to a position in which the frame is generally vertical, and the cable is then attached to the cross-piece of the frame, locking the handle to the frame holding the object to be raised in an upright position. The device pivots about the base to fold flat for storage.

A jack for raising a snowmobile, to permit raising of the snowmobile tracks off a surface. A jack particularly adapted for inclining a snowmobile enabling exposure of the underside thereof for maintenance of the snowmobile, and for preventing freezing of the snowmobile track onto a surface during storage of the snowmobile. The jack includes a base, having a non-skid bottom surface, a triangular shaped frame, having two upright legs and a lower leg, the frame pivotably attached at the lower leg to the base, and a handle. The handle, connected by a bolt, pivots about the frame, the handle having a proximal hook end for engaging the snowmobile and a distal grip end for gripping manually by the user. The frame also includes a crosspiece interconnecting the two upright legs of the triangular shaped frame. The crosspiece is engaged by an engagement means to the first end of a cable. The cable attached to the handle at a second end. The handle is pivoted by the user manually to engage the snowmobile with the hook end of the handle. The snowmobile is then raised by the jack to a generally upright, vertical position. The jack maintains the snowmobile in an upright position.

It is an advantage of the present invention to use a grid as a base because the grid base is received by the snow covered ground assisting to anchor the jack in position on the ground. In this way, having a grid works better than having a flat rectangular base.

It is also an advantage of the present invention to use a jack of relatively light weight, namely, less than ten pounds. Because the jack is so light weight, it is easy to transport in the user's vehicle and easy for the user to move the jack into position. Being able to fold the jack flat for storage is a further advantage that increases the jack's portability and ease of storage.

Because the jack is constructed of readily available metal tubing, and requires few manipulations to construct, the jack is economical to produce. The jack may be easily transported and positioned for use and enables the user to lift a heavy object, such as a snowmobile, without much physical effort by the user.

A further advantage is the use of a relatively large base. In use, the frame is positioned over the base. In use, the jack is locked into place, in a generally vertical position, to support the snowmobile or other heavy object. The large base increases the jack's stability and therefore, increases the safety to the user.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but nonlimiting example.

Figure 1:
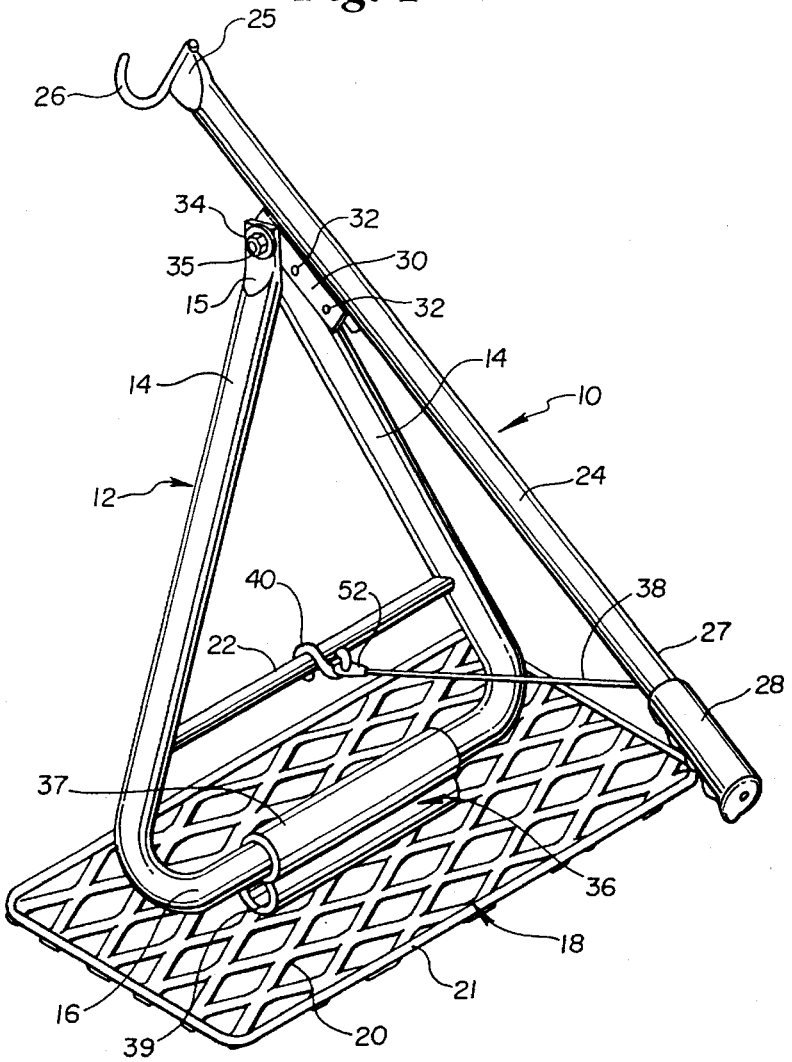
FIG. 1 is a perspective view of the invention.
Figure 2:
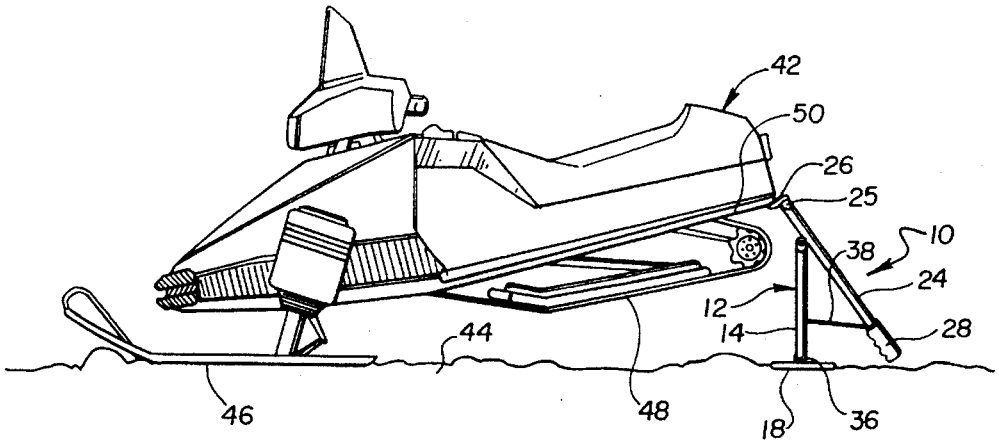
FIG. 2 is a side elevational view of the invention with the snowmobile in the jacked up position.
Figure 3:
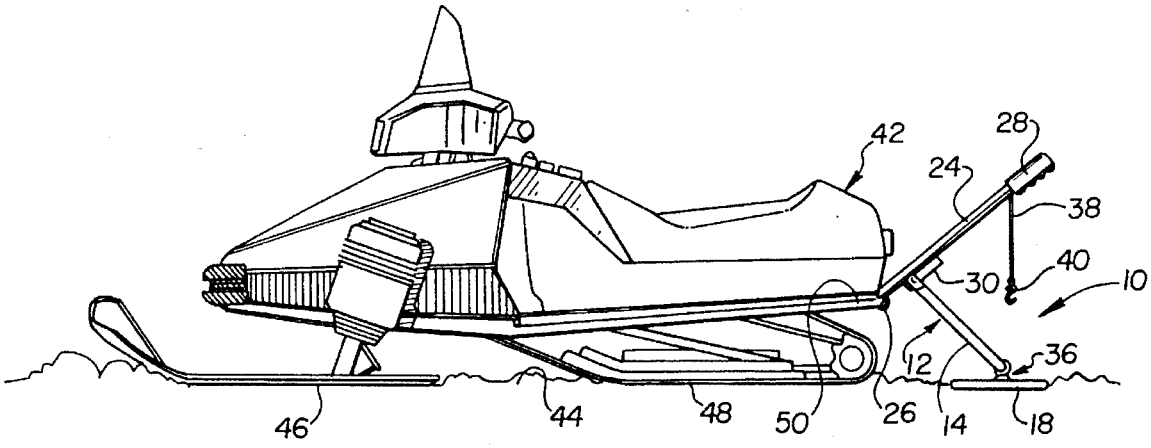
FIG. 3 is a side elevational view of the invention with the snowmobile in the down position.

As shown in FIG. 1., a jack 10 comprises a triangular shaped frame 12. Two upright legs 14, of equal length, form the triangle with a lower leg 16. The lower leg 16 is pivotably attached to a base 18. A handle 24 is pivotably attached to the frame 12 by a bolt 34 through taper 15, the point at which the two upright legs 14 meet. The base 18, of rectangular shape, is formed of a metal grid 20, outlined with metal rod 21 for support. The base 18 has a non-skid bottom surface, not shown. The handle 24, a length of metal tubing, has a proximal end 25 ending in a hook 26, and a distal end 27, ending in a grip 2e. The hook 26 is used to engage the object to be lifted, e.g. snowmobile 42 as shown in FIGS. 2 & 3. The grip 28 is grasped by the user manually to provide leverage to lift the object. A crosspiece 22 interconnects the two upright legs 14 of the triangular shaped frame 12 at a predetermined point on each upright leg 14. The crosspiece 22 is generally parallel to the base 18. A cable 38 is attached to the handle 24. An engagement means 40 at a first end of the cable 38 engages the crosspiece 22, holding the jacked up object upright when the jack 10 is in a generally upright or vertical position. The crosspiece 22, in addition to providing a place for attachment of engagement means 40, crosspiece 22 also strengthens frame 12. When not in use, the frame 12 pivots about the base 18 and the handle 24 pivots about the frame 12, enabling the jack 10 to fold flat for storage.

As shown in FIG. 1, the jack 10 has a triangular shaped frame 12 formed of round metal tubing such as rolled steel tubing. Other rigid materials such as other metals, hard plastics, or fiberglass could be used throughout. The frame 12 consists of two upright legs 14 of equal length that meet at taper 15. The third side of this triangular shape is formed by lower leg 16. Crosspiece 22, which runs parallel to lower leg 16, interconnects upright legs 14.

The handle 24, also of round metal tubing, is of a length longer than any of the legs of the frame 12. Handle 24 is attached to frame 12 at taper 15 by means of nut 35 and bolt 34, or other fastening means, interconnecting frame 12 to handle 24 at adjustment bracket 30. A taper 15 of each upright leg 14 has a bore, not shown, for receiving bolt 34 therethrough. Having two tapers 15 strengthens the frame 12. Adjustment holes 32 are formed in adjustment bracket 30 to receive fasteners for attaching handle 24 to frame 12. The user may, in effect, lengthen or shorten the handle 24 depending of which adjustment hole 32 is selected. Having a longer handle 24 enables the user to lift the object higher relative to the base.

The proximal end of handle 24 has a taper 25 on which is fixedly attached, by welding or other means, hook 26. In actual use conditions, a steel rod of a size to accommodate the dimensions of taper 25, is welded to handle 24 as hook 26. Distal end 27 of handle 24 has a hand grip 28. Also affixed to distal end 27 of handle 24 is cable 38 which has an engagement means 40 attached at the opposite end which may be used to engage crosspiece 22 to lock handle 24 in upright position.

Base 18, of rectangular shape, is an expanded flattened metal grid 20 surrounded and reinforced by a metal rod edging 21. It has been found that a grid 20 works better than a flat rectangular base because the grid 20 is received by and sunk into the snow or other surface on which the jack 10 is operated providing a more stable base 18. In addition, grid 20 is dipped into or otherwise coated with liquid rubber or plastic which, when hardened, acts to provide a non-skid surface on the bottom of grid 20.

Frame 12 is pivotably attached to base 18 by hinge 36 which consists of an upper tube 37, of a diameter larger than that of lower leg 16, which is affixed on the outside lower leg 16 by welding or other means. Spacer tube 39, is later welded to the lower edge of lower tube 16. Both elements of hinge 36 are of round steel tubing although other metals, hard plastic or fiberglass tubing could be used. Upper tube 37 is of a diameter greater than that of lower leg 16. Lower leg 16 of frame 12 is received by and turns within upper tube 37.

Spacer tube 39 allows grid 20 to be dipped or otherwise coated in liquid rubber or plastic without the rubber or plastic coating adhering to lower leg 16 or upper tube 37 which would interfere with lower leg 16 turning within upper tube 37.

FIG. 3 illustrates how jack 10 is positioned to engage the bumper 50, or other edge of housing, of snowmobile 42. Base 18 is positioned near the rear of snowmobile 42. Hook 26 engages bumper 50 and handle 24 is used as a lever with the fulcrum at the point of attachment of handle 24 to frame 12 by bolt 34 at taper 15. The handle 24 is pivoted manually about the frame 12 to engage the object to be lifted, here a snowmobile 42. Downward pressure on handle 24 raises the object to a position in which the frame 12 is generally vertical, FIG. 2. The object to be lifted, here a snowmobile 42, is locked into a raised position by manually connecting the cable 38 to engage cross-piece 22 of the frame 12, with engagement means 40, locking the handle 24 to the frame 12, again shown at FIG. 2. In this position, track 48 is held completely above the ground 44 so that only the skis 46 of the snowmobile 42 are in contact with the ground 44.

The cable 38 is attached to handle 24 by having a first end of cable 38 received through a hole, not shown, formed in handle 24 near the distal end 27. A metal ferrule, not shown, is attached to the cable 38 inside the tube of handle 24 to anchor cable 38 to handle 24. Attached to the opposite end of cable 38 is engagement means 40, also attached by a metal ferrule 52.

Figure 4:
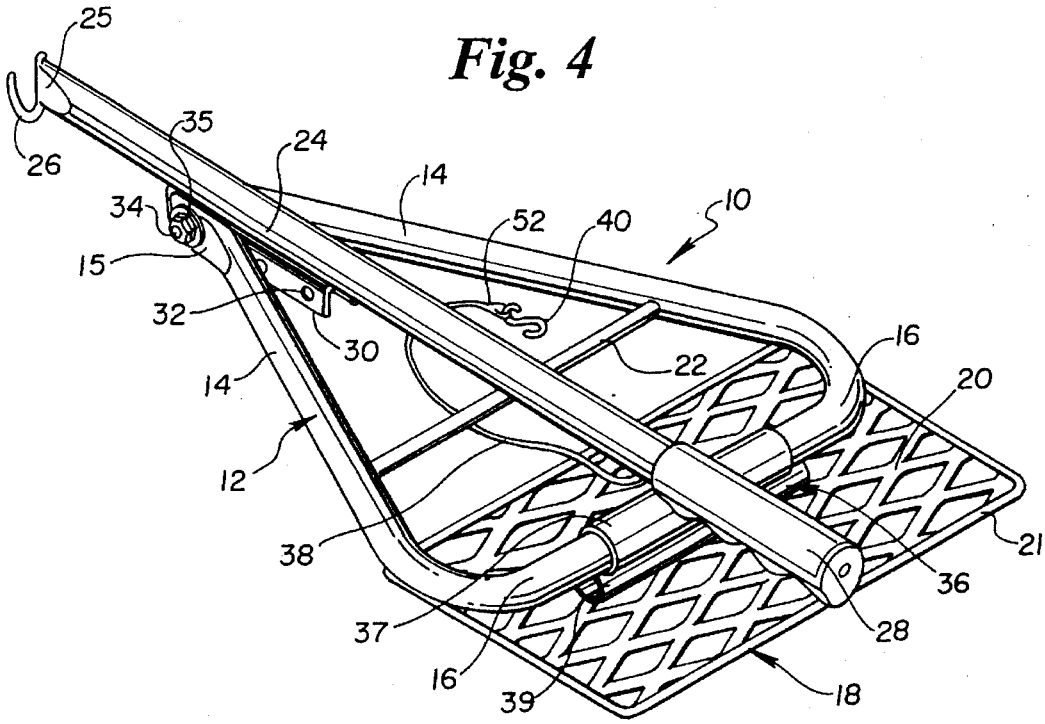
FIG. 4 is a perspective view of the invention in the folded, storage position.

FIG. 4 illustrates the jack be folded into a relatively flat position for storage. In this position, frame 12 has been pivoted about base 18 by turning lower leg 16 within upper tube 37 so that frame 12 is generally parallel to base 18. Handle 24 has been pivoted at taper 15 so that handle 24 is also generally parallel to frame 12 and base 18. In addition to folding relatively flat for easy storage, for example in a car trunk, the jack 10 weighs only a few pounds making it generally light in weight as compared to the available jacks, weighing approximately 30 pounds or more.

The invention is made by cutting round steel tubing a predetermined length to form frame 12. A section of tubing of a wider diameter is cut to provide upper tube 37. Upper tube 37 is placed over frame 12. To form the frame 12, ends of a length of tubing are pinched, each end forming a taper 15. Holes are bored at taper 15. Tubing is then formed into a triangle to form frame 12, making certain that upper tubing 37 is centered on tubing. Crosspiece 22 is welded into place on frame 12. A sheet of flattened metal grid is cut into a rectangular shape of predetermined dimensions. Round metal rod 21 is welded on grid 20 to add strength to base 18. Spacer tubing 39 is welded onto the center of base 18. Upper tubing 37 is welded onto spacer tubing 39. Handle 24 is cut of a predetermined dimension and a hole is bored into handle 24, not shown, to receive a first end of cable 38, cable 38 cut to predetermined dimensions. First end of cable 38 is retained within handle 24 by use of a metal ferrule, not shown, pinched into place. Second end of cable 38 has engagement means 40 welded thereon for engaging crosspiece 22 of frame 12 when jack 10 is in its upright position of use. Adjustment bracket 30, having holes 32 previously formed therein, is welded onto handle 24. Assembled jack 10 is then painted and the base 18 is dipped into liquid rubber or plastic. Handle grip 28 is attached on distal end 29 of handle 24, bolt 34 attaches handle 24 at adjustment bracket 30 to frame Although the present invention has been described in considerable detail with reference to certain preferred versions thereof, other versions are possible. For example, to accommodate the newer snowmobiles that have tracks having less tautness so that the tracks hang down further when the snowmobile is supported with the tracks suspended above the ground, the dimensions of jack 10, especially the length of frame 12 and handle 24 may be increased to accommodate the need to suspend the snowmobile 42 higher above the ground 44. Therefore, the spirit and scope of the appended claims should not be limited to the description of the preferred versions contained herein.

What is claimed is:

1. A jack for raising an object to an inclined position, the jack comprising:

a) a rectangular shaped base;

b) a triangular shaped frame, having two upright legs and a lower leg, said frame hingedly attached at said lower leg to said base;

c) a handle pivotably attached to said frame, said handle having a proximal hook end and a distal grip end;

d) a crosspiece interconnecting said two upright legs of said triangular shaped frame at a midpoint of each said upright leg;

e) means for pivoting said handle to engage the object and position said object in an inclined position; and f) a cable, having engagement means at a first end, said cable affixed at a second end to said distal end of said handle, said cable for engaging said handle to said crosspiece, securing the object in an inclined position relative to the base.

2. The device of claim 1, wherein said object to be lifted is a snowmobile.

3. The device of claim 1, wherein said frame hinges about said base enabling the device to be stored in a relatively flat position.

4. The device of claim 1 wherein said base has a non-skid bottom surface.

5. A jack for raising a snowmobile to permit raising tracks off a surface, comprising:

a) a rectangular shaped base;

b) a triangular shaped frame, having two upright legs and a lower leg, said frame pivotably attached at said lower leg to said base;

c) a handle pivotably attached at the middle portion of said frame, said handle having a proximal hook end and a distal grip end;

d) a crosspiece interconnecting said two upright legs of said triangular shaped frame at a midpoint of each said upright leg;

e) means for pivoting said handle for engaging and inclining said snowmobile; and f) cable means, having engagement means attached at a first end, attached at a second end to said distal end of said handle, said cable means for attaching said handle to said crosspiece when said jack is in its position of use maintaining the snowmobile in an inclined position relative to said base.

6. The jack of claim 5, wherein said base is planar with a nonskid bottom surface.

7. The jack of claim 5, wherein the frame hinges about the base, enabling the jack to be stored in a relatively flat position.

8. The jack of claim 5, wherein the frame and the handle are of tubular steel.

9. The jack of claim 5, wherein the two upright legs are of equal length and the handle is longer than any of the legs.

10. A jack for raising objects to an inclined position, the jack comprising:

a) a supporting base;

b) a triangular shaped frame, having two upright legs and a lower leg, the frame hingedly attached to the base by the lower leg;

c) a handle having a proximal hook end and a distal grip end, the handle proximal end pivotally attached to the frame at the intersection of the upright legs;

d) a crosspiece interconnecting the two upright legs at about a midpoint of each upright leg;

e) a cable having a proximal and a distal end, the cable proximal end attached to the handle distal end and the cable distal end having an engaging means;

such that, to raise the object to the inclined position, the jack is positioned with the base beneath the object and the hook is attached to the object, the distal grip end of the handle is lowered toward the base, thereby raising the hook and inclining the attached object, and the engaging means is engaged to the crosspiece, thereby securing the object in the inclined position relative to the base.

11. The jack of claim 10, wherein the object to be inclined is a snowmobile to be raised at a rear of the snowmobile.

12. The jack of claim 10, wherein the frame hinges about the base, enabling the jack to be stored in a relatively flat position.

13. The jack of claim 10, wherein the base is planar with a nonskid bottom surface.

14. The jack of claim 10, wherein the frame and handle are of tubular steel.

15. The jack of claim 10, wherein the two upright legs are of equal length and the handle is longer than any of the legs.

* * * * *